US011384654B2

(12) United States Patent
Smiddy et al.

(10) Patent No.: US 11,384,654 B2
(45) Date of Patent: Jul. 12, 2022

(54) MATEFACE FOR BLADE OUTER AIR SEALS IN A GAS TURBINE ENGINE

(71) Applicant: United Technologies Corporation, Farmington, CT (US)

(72) Inventors: Winston Gregory Smiddy, Manchester, CT (US); San Quach, Southington, CT (US); Matthew D. Parekh, Farmington, CT (US); Jeffrey T. Morton, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 26 days.

(21) Appl. No.: 16/686,540

(22) Filed: Nov. 18, 2019

(65) Prior Publication Data

US 2021/0148245 A1 May 20, 2021

(51) Int. Cl.
*F01D 11/10* (2006.01)
*F01D 25/14* (2006.01)

(52) U.S. Cl.
CPC ..... *F01D 11/10* (2013.01); *F01D 25/14* (2013.01); *F05D 2240/11* (2013.01); *F05D 2250/71* (2013.01); *F05D 2260/202* (2013.01)

(58) Field of Classification Search
CPC . F01D 9/04; F01D 11/08; F01D 11/10; F01D 25/12; F01D 25/14; F05D 2240/11; F05D 2260/202
See application file for complete search history.

(56) References Cited

U.S. PATENT DOCUMENTS

| | | | | |
|---|---|---|---|---|
| 5,374,161 | A | 12/1994 | Kelch et al. | |
| 6,261,053 | B1 | 7/2001 | Anderson et al. | |
| 6,533,542 | B2 * | 3/2003 | Sugishita | F01D 5/145 415/139 |
| 8,128,349 | B2 | 3/2012 | Lutjen et al. | |
| 8,287,234 | B1 | 10/2012 | Liang | |
| 2005/0067788 | A1 | 3/2005 | Liang | |
| 2017/0016340 | A1 * | 1/2017 | Sakamoto | F01D 5/143 |

(Continued)

FOREIGN PATENT DOCUMENTS

| | | |
|---|---|---|
| EP | 1022437 | 7/2000 |
| EP | 1225308 | 7/2002 |

(Continued)

OTHER PUBLICATIONS

European Search Report for Application No. 20208194.9 dated Apr. 16, 2021.

*Primary Examiner* — Eldon T Brockman
*Assistant Examiner* — Danielle M. Christensen
(74) *Attorney, Agent, or Firm* — Carlson, Gaskey & Olds, P.C.

(57) ABSTRACT

A gas turbine engine includes one of a turbine section and a compressor section having multiple stages. At least one of the stages defines an outer diameter comprised of a plurality of circumferentially arranged blade outer air seals. Each blade outer air seal is spaced from each adjacent blade outer air seal in the plurality of circumferentially arranged blade outer air seals via a mateface gap. The mateface gap is oblique to a radius of the gas turbine engine, such that air entering the mateface gap is directed to an inner diameter surface of at least one of the blade outer air seals in the plurality of blade outer air seals.

16 Claims, 2 Drawing Sheets

(56) References Cited

U.S. PATENT DOCUMENTS

| | | | | |
|---|---|---|---|---|
| 2017/0306781 | A1* | 10/2017 | Lewis | F01D 11/08 |
| 2018/0238179 | A1 | 8/2018 | Quach et al. | |
| 2018/0238545 | A1 | 8/2018 | Quach et al. | |
| 2018/0238547 | A1 | 8/2018 | Quach et al. | |
| 2018/0335211 | A1 | 11/2018 | Quach et al. | |

FOREIGN PATENT DOCUMENTS

| | | |
|---|---|---|
| EP | 3536933 | 9/2019 |
| GB | 2356022 | 5/2001 |

* cited by examiner

MATEFACE FOR BLADE OUTER AIR SEALS IN A GAS TURBINE ENGINE

TECHNICAL FIELD

The present disclosure relates generally to gas turbine engine flowpath construction, and more specifically to a contoured mateface configuration for utilization in a blade outer air seal.

BACKGROUND

Gas turbine engines, such as those utilized in commercial and military aircraft, include a compressor section that compresses air, a combustor section in which the compressed air is mixed with a fuel and ignited, and a turbine section across which the resultant combustion products are expanded. The expansion of the combustion products drives the turbine section to rotate. As the turbine section is connected to the compressor section via a shaft, the rotation of the turbine section further drives the compressor section to rotate. In some examples, a fan is also connected to the shaft and is driven to rotate via rotation of the turbine as well.

Each of the compressor, combustor and turbine section are fluidly connected via a primary flowpath, with the outer diameter of the primary flowpath being defined at least partially by a set of circumferentially arranged blade outer air seals.

SUMMARY OF THE INVENTION

In one example, a gas turbine engine includes one of a turbine section and a compressor section comprised of a plurality of stages, at least one of the stages in the plurality of stages defining an outer diameter comprised of a plurality of circumferentially arranged blade outer air seals, each blade outer air seal being spaced from each adjacent blade outer air seal in the plurality of circumferentially arranged blade outer air seals via a mateface gap, wherein the mateface gap is oblique to a radius of the gas turbine engine, such that air entering the mateface gap is directed to an inner diameter surface of at least one of the blade outer air seals in the plurality of blade outer air seals.

In another example of the above gas turbine engine, the mateface gap is defined by a first surface of a first blade outer air seal in the plurality of circumferentially arranged blade outer air seals and defined by a second surface of a second blade outer air seal in the plurality of circumferentially arranged blade outer air seals.

In another example of the any of the above gas turbine engines, the first surface and the second surface are complimentary angled planar surfaces relative to the gas turbine engine radius.

In another example of the any of the above gas turbine engines, the first surface and the second surface are planar surfaces and are oblique to each other.

In another example of the any of the above gas turbine engines, at least one of the first surface and the second surface includes a curvature.

In another example of the any of the above gas turbine engines, each of the first surface and the second surface includes a curvature.

In another example of the any of the above gas turbine engines, the curvature of the first surface and the curvature of the second surface is complimentary.

In another example of the any of the above gas turbine engines, at least one of the curvatures is a complex curvature.

In another example of the any of the above gas turbine engines, each of the curvatures is a complex curvature.

In another example of the any of the above gas turbine engines, at least one of the mateface gaps includes a nozzle fluid exit.

In another example of the any of the above gas turbine engines, each of the mateface gaps includes a nozzle fluid exit.

In another example of the any of the above gas turbine engines, an outer diameter portion of each mateface gap is sealed via an interstage seal.

In another example of the any of the above gas turbine engines, each interstage seal is a featherseal.

One exemplary method for film cooling an internal surface of a gas turbine engine component includes angling a mateface gap such that air exiting the mateface gap is directed along an inner diameter surface of one of an outer diameter component.

In another example of the above described method, the outer diameter component is a blade outer air seal.

Another example of the above described method includes diffusing air exiting the mateface gap using non-complimentary blade outer air seal surfaces.

Another example of the above described method includes accelerating air exiting the mateface gap.

An exemplary blade outer air seal for a gas turbine engine includes a platform defining an inner diameter surface, a first mateface surface extending from a first end of the inner diameter surface and a second mateface surface extending from the inner diameter surface, at least one of the first mateface surface and the second mateface surface being oblique to a radius of a gas turbine engine.

In another example of the above blade outer air seal, the first mateface surface and the second mateface surface are complimentary.

In another example of any of the above blade outer air seals, at least one of the first mateface surface and the second mateface surface is curved.

These and other features of the present invention can be best understood from the following specification and drawings, the following of which is a brief description.

DETAILED DESCRIPTION

Figure 1:
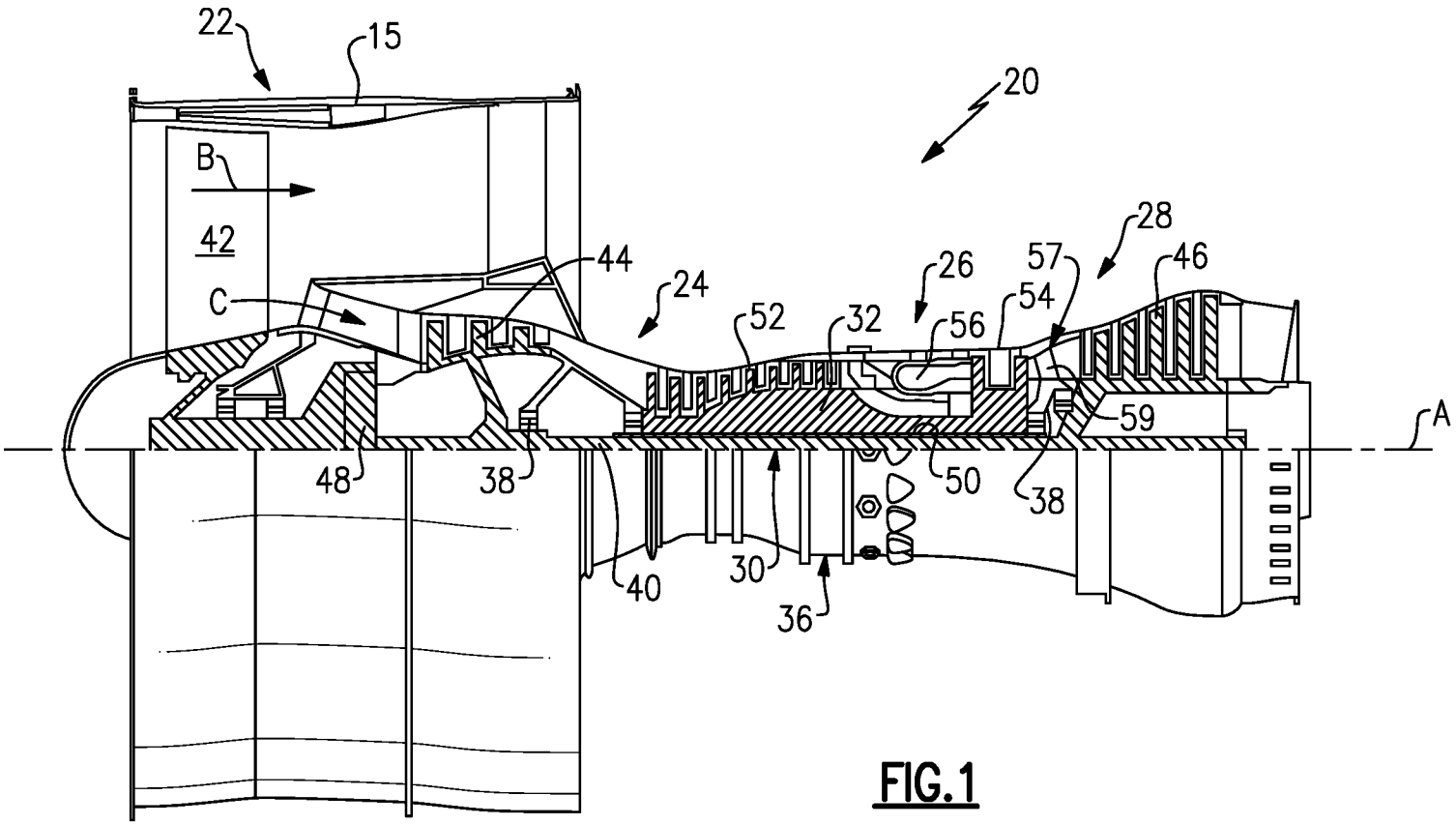
FIG. 1 illustrates an exemplary gas turbine engine according to a first example.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Within the compressor section 24 and the turbine section 28 are multiple stages with each stage including a set of circumferentially arranged rotors paired with a set of circumferentially arranged stators. Radially outward of the rotors in a given stage is an outer diameter defined by circumferentially arranged blade outer air seals, with the blade outer air seals being connected via intersegment seals. In order to cool the blade outer air seals, air is flowed circumferentially through the blade outer air seal and expelled from a circumferential edge of the blade outer air seal, into a gap between the segments. The facing surfaces of adjacent blade outer air seals are referred to as matefaces. The air is ejected from between the matefaces into the core gaspath flow, and expelled along the core gaspath. Any excess cooling capacity in the ejected air is wasted and represents a loss of efficiency.

Figure 2:
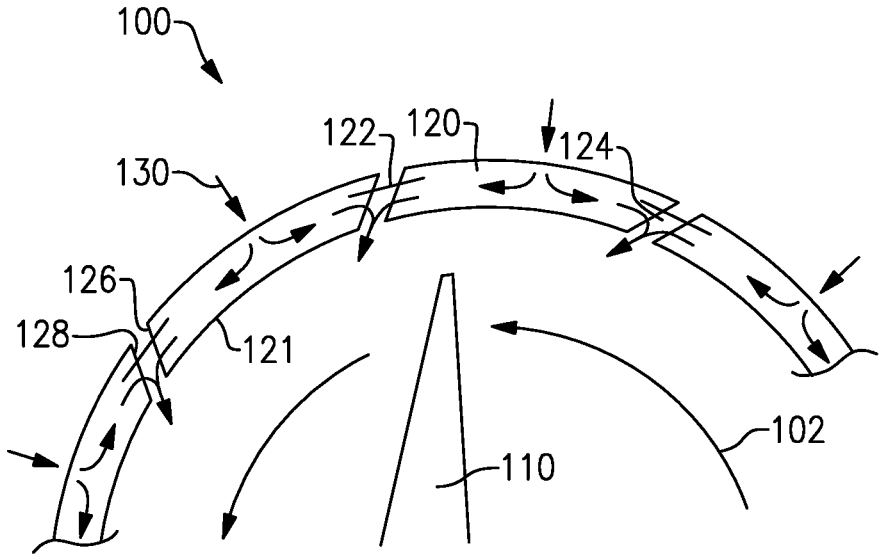
FIG. 2 schematically illustrates a partial view of an exemplary turbine stage.

With continued reference to FIG. 1, FIG. 2 schematically illustrates a partial stage 100 including a rotor 110 and multiple circumferentially arranged blade outer air seals 120 radially outward of the rotor 110. While only a single rotor 110 is illustrated for explanatory effect, a practical implementation will include substantially more rotors. Each of the blade outer air seals 120 is connected to the circumferentially adjacent blade outer air seal 120 via an intersegment seal 122. The intersegment seal 122 seals a radially outward end of an intersegment gap 124 between adjacent blade outer air seals 120. In one example, the intersegment seal 122 is a feather seal. An airstream 130 is provided to each blade outer air seal 120, and is flowed circumferentially through the blade outer air seal 120 to provide cooling to the blade outer air seal 120.

Each of the blade outer air seals includes two circumferentially facing sides 126, 128 with at least one of the sides 126, 128 being at least partially skew relative to the radius of the engine 20. By skewing at least one of the sides 126, 128 the airflow passed into the intersegment gap 124 is directed along a radially inward facing surface 121 of the blade outer air seal 120, thereby enhancing the cooling effect provided to the blade outer air seal 120.

The directing and contouring of the sides 126, 128 serves a dual purpose of directing leakage or post-part-cooling flow such that the flow cools the facing surface 126, 128 and provides a film coverage of an adjacent blade outer air seal 120 before being disposed of in the primary flowpath. In addition to this, the contours of the facing surfaces 126, 128 are in some examples configured to reduce ingestion of gaspath air into the intersegment cavity 124, thereby reducing oxidization of the blade outer air seal 120.

In order to further enhance the film cooling effect, and prevent flowpath air from being drawn into the interstage gap 124, each interstage gap 124 is angled aligned with the rotation 102 direction of the rotors 110 such that the outlet of the interstage gap 124 is rotationally after the inlet (i.e. the outlet is counterclockwise of the inlet for a system with counterclockwise rotor rotation). In alternative examples, the rotation 102 can be reversed with the same alignment of the interstage gaps 124.

With continued reference to FIGS. 1 and 2, FIGS. 3 through 7 illustrate potential facing surfaces pairs 302 (i.e. matefaces) defining an interstage gap 306 that could be used within a gas turbine engine. While illustrated as isolated surface pairs 302, it is appreciated that exemplary gas turbine engines could be constructed using a single interstage gap configuration in between each blade outer air seal, or any combination of the illustrated interstage gap configurations within a given stage. In each example, the configuration assumes a clockwise rotating stage. In examples where the stage is rotating counterclockwise, the orientation of each of the exemplary interstage gaps 124 would be mirrored.

Figure 3:
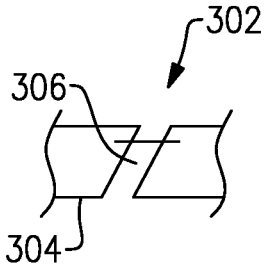
FIG. 3 schematically illustrates a first example interstage gap.

With regards to the first example facing surface pairs 302, illustrated in FIG. 3, each of the facing surfaces is straight and angled complimentary to the paired surface. The straight surfaces reduce diffusion of the air exiting the interstage gap 306, and the complimentary angles direct the air along the interior surface 304 of the counterclockwise blade outer air seal.

Figure 4:
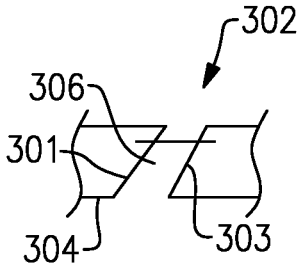
FIG. 4 schematically illustrates a second example interstage gap.

With regards to the second example facing surface pair 302, FIG. 4 illustrates an example where both facing surfaces 301, 303 are angled, and where a counterclockwise surface 301 is positioned at a steeper angle than the clockwise surface 303. The straight surfaces 301, 303 minimize diffusion, while the steeper counterclockwise surface 301 directs air exiting the interstage gap 306 along the counterclockwise surface 304 to enhance film cooling.

Figure 5:
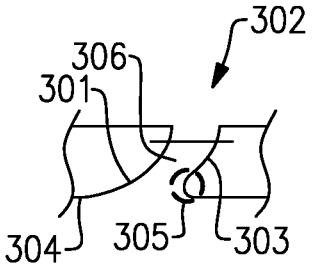
FIG. 5 schematically illustrates a third example interstage gap.

With regards to the third example facing surface pair 302, FIG. 5 illustrates an example where the counterclockwise surface 301 is curved, and the clockwise surface 303 includes a complementary curve with a diffuser portion 305. The example of FIG. 5 utilizes the complimentary curvature to direct airflow exiting the interstage gap 306 along the inward surface 304 of the counterclockwise blade outer air seal. The diffuser portion 305 is a rounded end of the clockwise surface 303. The diffuser portion 305 introduces diffusion into the air exiting the interstage gap 306, while still maintaining the general direction of airflow toward the counterclockwise surface 304. In addition, the diffuser portion 305 provides a sufficient cross section to reduce a cooling requirement of the diffuser portion 305.

Figure 6:
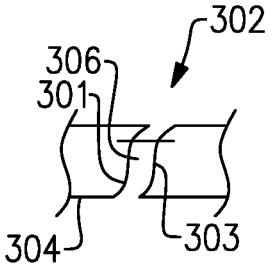
FIG. 6 schematically illustrates a fourth example interstage gap.

With regards to the fourth example facing surface pair 302, illustrated in FIG. 6, each of the surfaces 301, 303 includes a complimentary complex curvature. As used herein, the complex curvature refers to the curvatures of the surfaces 301, 303 including multiple turns with arcs having an inconsistent radius of curvature. The utilization of complex curvatures can provide better or more efficient film coverture, outboard sealing, more consistent diffusion, better structural properties, better mateface cooling, as well as other benefits relative to other example architectures.

Figure 7:
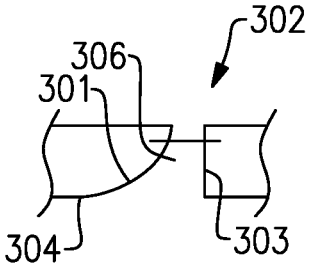
FIG. 7 schematically illustrates a fifth example interstage gap.
Figure 8:
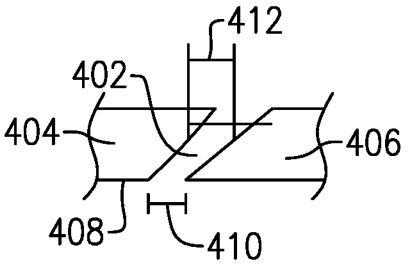
FIG. 8 schematically illustrates an interstage gap including a nozzle feature.

With regards to the fifth example facing surface pair 302, the facing surface pair 302 of FIG. 7 is a hybrid with the counterclockwise surface 301 being curved, and the clockwise surface 303 being straight. As illustrated herein, the clockwise surface 303 is aligned with the radius of the engine, however it is contemplated that alternative examples where the surface is angled relative to the radius (as in the examples of FIGS. 3 and 4).

With continued reference to FIGS. 1-7, FIG. 8 schematically illustrates an interstage gap 402 including a cross sectional outlet area 410 that is smaller than a cross sectional area 412 of the gap 402 where the air enters the gap 402 from the blade outer air seals 404, 406. The creation of the smaller cross section area 410 induces a nozzle effect accelerating the airflow as it is directed to the counterclockwise surface 408. The acceleration allows for the air to be targeted and provide more efficient cooling in some examples. While illustrated with regards to paired straight surfaces it is appreciated that any of the configurations utilizing straight surfaces, contoured surfaces and/or complex curvatures could incorporate the nozzle feature in a similar manner.

While described above and illustrated in FIGS. 2-8 within the context of turbine section blade outer air seals, it is appreciated that the contoured paired faces can be beneficially incorporated into any circumferentially arranged flowpath boundary component and are not limited in application to blade outer air seals or limited to turbine stages. By way of example, the contoured matefaces could be applied to static vanes, structural supports, and the like and/or may be disposed in the compressor section of the gas turbine engine.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gas turbine engine comprising:

one of a turbine section and a compressor section comprised of a plurality of stages;

at least one of the stages in the plurality of stages defining an outer diameter comprised of a plurality of circumferentially arranged blade outer air seals, each blade outer air seal being spaced from each adjacent blade outer air seal in the plurality of circumferentially arranged blade outer air seals via a mateface gap;

an airstream provided to each blade outer air seal and flowed circumferentially through each blade outer air seal to the mateface gap such that air enters each mateface gap from each blade outer air seal defining the mateface gap;

wherein the mateface gap is oblique to a radius of the gas turbine engine, such that air entering the mateface gap is directed to an inner diameter surface of at least one of the blade outer air seals in the plurality of blade outer air seals; and wherein each mateface gap is angled against the rotation direction of rotors radially inward of the blade outer air seals such that the outlet of each mateface gap is rotationally between an inlet of the mateface gap.

2. The gas turbine engine of claim 1, wherein the mateface gap being defined by a first surface of a first blade outer air seal in the plurality of circumferentially arranged blade outer air seals and defined by a second surface of a second blade outer air seal in the plurality of circumferentially arranged blade outer air seals.

3. The gas turbine engine of claim 2, wherein the first surface and the second surface are complimentary angled planar surfaces relative to the gas turbine engine radius.

4. The gas turbine engine of claim 2, wherein the first surface and the second surface are planar surfaces and are oblique to each other.

5. The gas turbine engine of claim 2, wherein at least one of the first surface and the second surface includes a curvature.

6. The gas turbine engine of claim 5, where each of the first surface and the second surface includes a curvature.

7. The gas turbine engine of claim 6, wherein the curvature of the first surface and the curvature of the second surface is complimentary.

8. The gas turbine engine of claim 6, wherein at least one of the curvatures is a complex curvature.

9. The gas turbine engine of claim 8, wherein each of the curvatures is a complex curvature.

10. The gas turbine engine of claim 1, wherein at least one of the mateface gaps includes a nozzle fluid exit.

11. The gas turbine engine of claim 10, wherein each of the mateface gaps includes a nozzle fluid exit.

12. The gas turbine engine of claim 1, wherein an outer diameter portion of each mateface gap is sealed via an interstage seal.

13. The gas turbine engine of claim 12, wherein each interstage seal is a feather seal.

14. The gas turbine engine of claim 12 wherein the airstream is provided to the mateface gap from at least one of the blade outer air seals at a position radially inward of the corresponding interstage seal.

15. The gas turbine engine of claim 12, wherein the airstream is provided to the mateface gap from each of the blade outer air seals defining the mateface gap at a position radially inward of the corresponding interstage seal.

16. A gas turbine engine comprising: one of a turbine section and a compressor section comprised of a plurality of stages; at least one of the stages in the plurality of stages defining an outer diameter comprised of a plurality of circumferentially arranged blade outer air seal, each blade outer air seal being spaced from each adjacent blade outer air seal in the plurality of circumferentially arranged blade outer air seals via a mateface gap; an airstream provided to each blade outer air seal and flowed circumferentially through each blade outer air seal to the mateface gap such that air enters each mateface gap from each blade outer air seal defining the mateface gap; wherein the mateface gap is oblique to a radius of the gas turbine engine, such that air entering the mateface gap is directed to an inner diameter surface of at least one of the blade outer air seals in the plurality of the blade outer air seals; and, wherein each mateface gap is angled against the rotation direction of rotors radially inward of the blade outer air seals such that the outlet of each mateface gap is rotationally before an inlet of the mateface gap.

* * * * *